US008919907B1

(12) United States Patent
Shimomura

(10) Patent No.: US 8,919,907 B1
(45) Date of Patent: Dec. 30, 2014

(54) INKJET PRINTING APPARATUS

(71) Applicant: Riso Kagaku Corporation, Tokyo (JP)

(72) Inventor: Kenji Shimomura, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/299,429

(22) Filed: Jun. 9, 2014

(30) Foreign Application Priority Data

Jun. 26, 2013 (JP) ..... 2013-133655

(51) Int. Cl.
*B41J 2/205* (2006.01)
*B41J 2/21* (2006.01)

(52) U.S. Cl.
CPC ..... *B41J 2/21* (2013.01)
USPC ..... 347/15; 347/8; 347/43

(58) Field of Classification Search
CPC ..... B41J 2/04526; B41J 2/04593; B41J 2/04508; B41J 2/04561; B41J 2/04535
USPC ..... 347/8, 14, 15, 43, 74, 78–80
See application file for complete search history.

(56) References Cited

U.S. PATENT DOCUMENTS 7,581,798 B2 * 9/2009 Arazaki ..... 347/12
7,651,186 B2 * 1/2010 Yoshida et al. ..... 347/14
2014/0168306 A1 6/2014 Bansyo

FOREIGN PATENT DOCUMENTS

JP 2010-234613 10/2010

* cited by examiner

*Primary Examiner* — Thinh Nguyen
(74) *Attorney, Agent, or Firm* — Greenblum & Bernstein P.L.C.

(57) ABSTRACT

An inkjet printing apparatus includes a printing unit including four inkjet heads configured to discharge black, cyan, magenta, and yellow inks, respectively, to a transferred sheet; and a control unit configured to control the printing unit, wherein the printing unit, when forming a gray image by the printing unit, forms a grey image with three color inks other than black when a level of influence on an ink landing position by an airflow under the inkjet head is a predetermined level or higher, forms the grey image with the black ink when the level of influence is lower than the predetermined level, and controls the printing unit to set higher print resolution and set smaller an ink discharge amount for one pixel from the inkjet head than when forming the gray image with other three color inks, in forming the gray image with the black ink.

2 Claims, 3 Drawing Sheets

FIG. 4
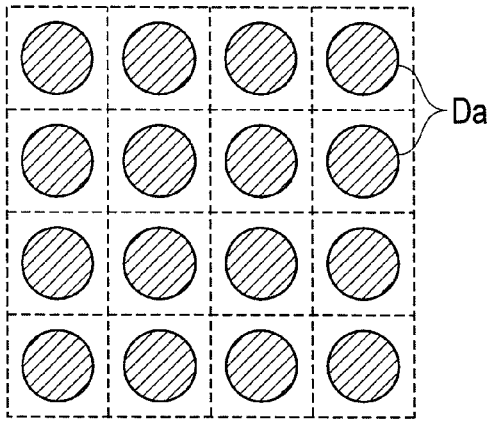
FIG. 5
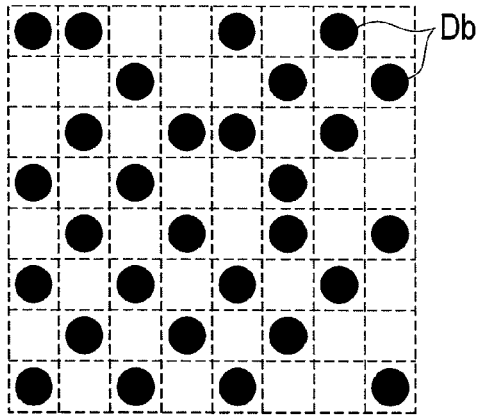
FIG. 6
| HEAD GAP | GRAY IMAGE PRINT QUALITY | | | |
|---|---|---|---|---|
| | EXPERIMENT EXAMPLE 1 | EXPERIMENT EXAMPLE 2 | COMPARISON EXAMPLE 1 | COMPARISON EXAMPLE 2 |
| H1 | C | A | D | B |
| H2 | C | D | D | D |

INKJET PRINTING APPARATUS

BACKGROUND

1. Technical Field

The present invention relates to inkjet printing apparatuses performing printing by discharging ink to a print medium from an inkjet head.

2. Background Art

Inkjet printing apparatuses forming an image by discharging ink droplets from a nozzle of an inkjet head and landing them to a sheet are being widely used.

Of the inkjet printing apparatuses, an inkjet printing apparatus of a line type performing printing by discharging the ink droplets from the fixed, long inkjet head while transferring the sheet has drawn attention in recent years in terms of speed-up.

Some inkjet printing apparatuses can perform full-color printing using black (K), cyan (C), magenta (M), and yellow (Y) inks (refer to, for example, Patent Literature 1).

When such an inkjet printing apparatus capable of performing the full-color printing forms a gray image having medium to low density, normally, it does not use the K ink but the C, M, Y inks to form the gray image. There are two reasons for that.

As a first reason, if the gray image having the low density is formed only with the K ink or the K, C, M, Y inks, many pixels are thinned out to form the gray image with less pixels (dots). Then, graininess is deteriorated.

As a second reason, with respect to a K dot, if a position of other color dot is deviated due to landing deviation, the gray image may have other color.

With the above-described two reasons, the inkjet printing apparatus capable of performing the full-color printing normally forms the gray image having the medium to low density using the three color inks of C, M, Y without using the K ink, but, a problem may occur even with such a method. For example, the positions of the C, M, Y ink dots are deviated from one another and, as a result, the gray image may have other color.

Thus, it can be considered to use only the K ink, raise resolution higher than set resolution (set to higher resolution), and decrease an ink discharge amount per one pixel (set to a smaller ink discharge amount), so as to form the gray image.

The graininess is described as below. "High graininess" or "good graininess" indicates a state in which, since the pixel included in the printed image is small, it is hardly visible. Thus, when the graininess is high, the printed image looks smooth. On the other hand, "low graininess" or "bad graininess" indicates a state in which, since the pixel included in the printed image is large, the pixel is easily visible. Thus, when the graininess is low, the printed image looks variable in grain and rough.

The graininess is an indication for evaluating the printed image by an impression when it is viewed with human eyes. Whether the graininess is high or low can be determined by mechanical measurement such as a size of the pixel included in the printed image, a level of arrangement of the pixels, and so on. The smaller the pixel is, or the more uniform the arrangement of the pixels is, the higher the graininess becomes. On the other hand, the larger the pixel is, or the less uniform the arrangement of the pixels is, the lower the graininess becomes.

With the higher resolution and the smaller ink discharge amount, the grain of the image can be reduced in size and, thus, deterioration of the graininess in the printed image can be reduced. Further, since only the K ink is used, the gray image would not have the other colors.

RELATED ART

Patent Literature

Patent Literature 1: Japanese Patent Application Laid-Open No. 2010-234613

SUMMARY

Problem to be Solved by the Invention

In a line type inkjet printing apparatus, an airflow is generated along with transfer of a sheet. The ink droplet discharged and flown from the inkjet head may be influenced by the airflow. The smaller the ink discharge amount (the number of the ink droplets) per one pixel, the more easily the ink droplets are influenced by the airflow, and thus deviation of landing position is easily generated. Further, the larger a head gap is, the larger the deviation of landing position caused by the influence of the airflow becomes.

When the gray image is formed with the C, M, Y inks, the dot positions of respective colors may be deviated from one another due to the influence of the airflow and the gray image may have the other colors.

On the other hand, as described above, when the higher resolution of the image and the smaller ink discharge amount are set so that the gray image is formed only with the K ink, since only the K ink is used, color of the gray image is not changed. However, in this case, since the smaller discharge amount of the K ink to be used is set, the deviation of landing position caused by the influence of the airflow is easily generated. The larger the head gap is, the larger the deviation of landing position becomes. When the deviation of landing position becomes larger, variation of local density is generated to lower the graininess of the image.

When the image is formed with the C, M, Y inks, compared to when the gray image is formed only with the K ink, for which the higher resolution of the image and the smaller ink discharge amount are set, the large amount of the ink in each color is discharged and, thus, the deviation of landing position caused by the influence of the airflow is smaller. Therefore, a level of change of the color of the gray image formed with the C, M, Y inks caused by the influence of the airflow is comparatively small.

With the above descriptions, when the head gap is large, the lowered graininess due to the deviation of landing position of the K ink described above may cause more serious deterioration of print quality rather than the change of the colors due to the position deviation of the dots of colors from one another, when the gray image is formed with the C, M, Y inks.

The present invention takes the above descriptions into consideration and is directed to provide the inkjet printing apparatus capable of reducing the deterioration of the image quality of the gray image.

Means to Solve the Problem

In order to achieve the above object, a first aspect of the present invention is an inkjet printing apparatus including a printing unit including four inkjet heads configured to discharge black, cyan, magenta, and yellow inks, respectively, to a transferred sheet; and a control unit configured to control the printing unit, wherein the control unit, when forming a gray image by the printing unit, determines whether or not a level of influence on an ink landing position by an airflow under the inkjet head is a predetermined level or higher, controls the printing unit to form the gray image with three color inks other than the black ink, when the level of the influence is a predetermined level or higher, controls the printing unit to form the gray image with the black ink, when the level of the influence is less than the predetermined level, and controls the printing unit to set higher print resolution and set smaller an ink discharge amount for one pixel from the inkjet head than when forming the gray image with other three color inks, in the control to form the gray image with the black ink.

A second aspect of the inkjet printing apparatus according to the present invention is an inkjet printing apparatus including a printing unit which includes four inkjet heads configured to discharge black, cyan, magenta, and yellow inks, respectively, to a transferred sheet and in which the black inkjet head performs print processing with a resolution higher than resolutions of other inkjet heads; and a control unit configured to control the printing unit, wherein the control unit, when forming a gray image by the printing unit, determines whether or not a level of influence on an ink landing position by an airflow under the inkjet head is a predetermined level or higher, controls the printing unit to form the gray image with three color inks other than the black ink, when the level of the influence is a predetermined level or higher, and forms the gray image by using only the black ink and setting smaller an ink discharge amount for one pixel from the inkjet head than when forming the gray image with the three color inks, when the level of the influence is lower than the predetermined level.

BRIEF DESCRIPTION OF DRAWINGS

FIG. 4 illustrates a dot image of a gray image printed without being subjected to drop data conversion processing.

FIG. 5 illustrates a dot image of a gray image printed after being subjected to the drop data conversion processing.

FIG. 6 illustrates a result of an experiment in which print quality of the gray image is checked according to the embodiment.

DETAILED DESCRIPTION

With reference to drawings, an embodiment of the present invention will be described below. Same or equivalent reference symbols are applied to same or equivalent components or configuration elements for each drawing. However, the drawings are schematically illustrated and different from actual components or configuration elements. Further, the diagrams include different relationships of dimensions and ratios from one another.

Furthermore, the embodiment described below indicates an example of an apparatus for specifically embodying a technical idea of the present invention, but does not specify material, a shape, a configuration, arrangement, and so on of each configuration component as below. According to the technical idea of the present invention, in scope of the claims, various types of modifications can be added.

Figure 1:
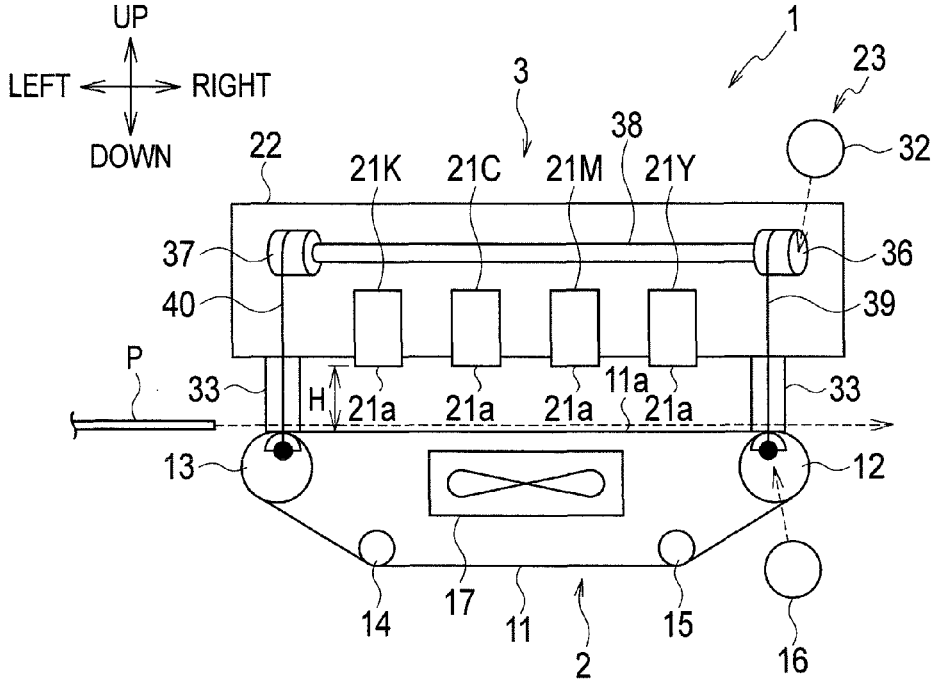
FIG. 1 is a schematic configuration diagram illustrating an inkjet printing apparatus according to an embodiment.
Figure 2:
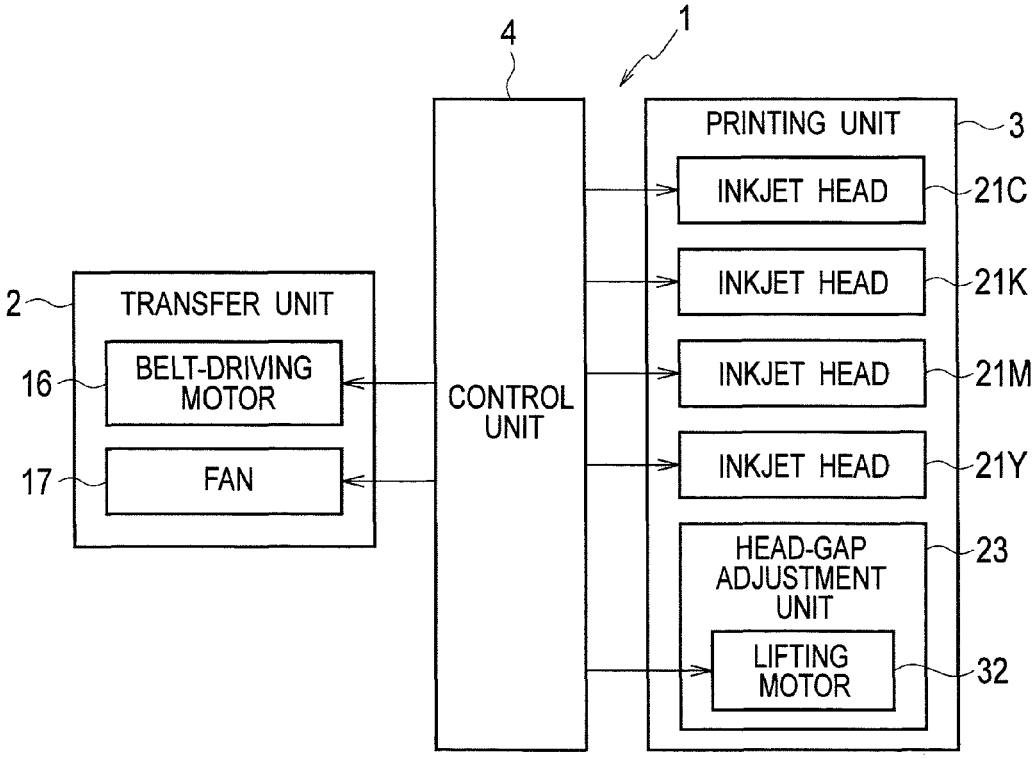
FIG. 2 is a control block diagram of the inkjet printing apparatus according to the embodiment.

FIG. 1 is a schematic configuration diagram illustrating an inkjet printing apparatus according to an embodiment of the present invention. FIG. 2 is a control block diagram illustrating the inkjet printing apparatus illustrated in FIG. 1. In descriptions below, a front direction of a paper surface in which a user is positioned illustrated in FIG. 1 is defined as a "front". As illustrated in FIG. 1, up, down, right, and left viewed from the user is defined as directions of up, down, right and left. A direction from left to right illustrated in FIG. 1 is a transfer direction of a sheet "P" that is a print medium. An upstream and a downstream described below mean those in the transfer direction.

As illustrated in FIGS. 1 and 2, an inkjet printing apparatus 1 includes a transfer unit 2, a printing unit 3, and a control unit 4.

The transfer unit 2 transfers the sheet "P" fed from a paper feed unit (not illustrated). The transfer unit 2 includes a conveyer belt 11, a driving roller 12, driven rollers 13, 14, 15, a belt-driving motor 16, and a fan 17.

The conveyer belt 11 is a circular belt held over the driving roller 12 and the driven rollers 13 to 15. The conveyer belt 11 is formed with a number of belt holes (not illustrated) for suctioning and holding the sheet "P". The conveyer belt 11 suctions and holds the sheet "P" on a transfer surface 11*a* with a suction force generated in the belt hole by drive of the fan 17. The transfer surface 11*a* is an upper surface of the conveyer belt 11 that is substantially horizontal between the driving roller 12 and the driven roller 13. The conveyer belt 11 rotates in a clockwise direction illustrated in FIG. 1 by rotation and drive of the driving roller 12. With this arrangement, the conveyer belt 11 endlessly moves to transfer the sheet "P" suctioned and held on the transfer surface 11*a* in a right direction.

The conveyer belt 11 is held over the driving roller 12 and the driven rollers 13 to 15. The driving roller 12 is rotated and driven by the belt-driving motor 16 to rotate the conveyer belt 11. The driven rollers 13 to 15 are driven by the driving roller 12 via the conveyer belt 11. The driven roller 13 is arranged a predetermined space apart from the driving roller 12 in a left direction at substantially same height as the driving roller 12. The driven rollers 14, 15 are arranged to be a predetermined space apart from each other in a horizontal direction below the driving roller 12 and the driven roller 13 at the substantially same height.

The belt-driving motor 16 rotates and drives the driving roller 12.

The fan 17 generates the airflow in a down direction. With this arrangement, the fan 17 suctions air via the belt hole of the conveyer belt 11 to generate negative pressure in the belt hole, so as to suction the sheet "P" onto the transfer surface 11*a*. The fan 17 is arranged between the driving roller 12 and the driven roller 13.

The printing unit 3 performs printing on the sheet "P" transferred by the transfer unit 2. The printing unit 3 is provided at an upper side of the transfer unit 2. The printing unit 3 is fixed in a casing (not illustrated) of the inkjet printing apparatus 1. The printing unit 3 includes inkjet heads 21K, 21C, 21M, 21Y, a head holder 22, and a head-gap adjustment unit 23. When discrimination of the color is not required, suffixes (C, K, M, Y) in Alphabet indicating the color in a reference symbol may not be described.

The inkjet heads 21K, 21C, 21M, 21Y discharge the inks in black (K), cyan (C), magenta (M), and yellow (Y), respectively. The inkjet heads 21K, 21C, 21M, 21Y are arranged in parallel with one another in the horizontal direction. Each color ink is layered and injected to a same pixel from the inkjet heads 21K, 21C, 21M, 21Y to form various types of colors. The inkjet head 21 includes a plurality of nozzles (not illustrated) formed on a discharge surface (lower surface) 21*a* facing the transfer surface 11*a* of the conveyer belt 11 and discharges the ink via the nozzle. The plurality of nozzles of the inkjet head 21 is arranged in a direction (forward-backward direction) orthogonal to the transfer direction of the sheet "P" at a predetermined nozzle pitch.

The head holder 22 holds the inkjet heads 21K, 21C, 21M, 21Y above the transfer unit 2. The head holder 22 is formed in a substantially cuboid-like shape having a hollow inside. The head holder 22 holds the inkjet head 21 with the discharge surface 21*a* of the inkjet head 21 protruded downwardly from a bottom surface of the head holder 22.

The head-gap adjustment unit 23 adjusts a head gap "H". The head gap "H" is a distance between the transfer surface 11*a* of the conveyer belt 11 and the discharge surface 21*a* of the inkjet head 21. The head-gap adjustment unit 23 includes a lifting mechanism unit 31, a lifting motor 32, and an adjustment member 33.

The lifting mechanism unit 31 moves up and down the transfer unit 2 with respect to the inkjet head 21. Two lifting mechanism units 31 are provided apart from each other in the forward-backward direction. The lifting mechanism unit 31 includes a pair of pulleys 36, 37, a shaft 38, and wires 39, 40.

The pulleys 36, 37 wind and unwind the wires 39, 40 respectively. The pulleys 36, 37 are rotatably supported in the head holder 22 apart from each other in the horizontal direction.

The shaft 38 connects the pair of pulleys 36, 37 with each other. The shaft 38 includes a long member extending in the horizontal direction, one end of the shaft 38 being fixed to the pulley 36 and the other end thereof being fixed to the pulley 37. With this arrangement, the pair of pulleys 36, 37 are rotated in synchronization.

The wires 39, 40 suspend and support the transfer unit 2. Each one end of the wires 39, 40 is connected to the transfer unit 2 and each other end thereof is wound on the pulleys 36, 37 respectively. The wires 39, 40 are wound or unwound by the rotation of the pulleys 36, 37 to move up and down the transfer unit 2.

The lifting motor 32 rotates and drives the pulleys 36, 37.

The adjustment member 33 adjusts the head gap "H". The adjustment member 33 is elevationally provided at a corner portion of the bottom surface of a head holder 43. The transfer unit 2 is protrudingly provided to a lower edge of the adjustment member 33 to position the transfer unit 2. The adjustment member 33 is configured to change length in a vertical direction according to the head gap "H".

The control unit 4 controls an action of each unit of the inkjet printing apparatus 1. The control unit 4 includes a CPU, a RAM, a ROM, a hard disk and the like.

When the gray image is formed, the control unit 4 performs control of whether to form the gray image with the three color inks of C, M, Y or to form the gray image only with the K ink according to a level of the influence of the airflow. More specifically, when the level of the influence of the airflow is a predetermined level or higher, the control unit 4 performs the control to form the gray image with the three color inks of C, M, Y other than the K ink. When the level of the influence of the airflow is less than the predetermined level, the control unit 4 performs control to form the gray image only with the K ink. When the gray image is formed only with the K ink, the control unit 4 performs the control to set the higher resolution and the smaller ink discharge amount for one pixel from the inkjet head 21 than when the gray image is formed with the C, M, Y inks.

The level of the influence of the airflow means the level of the influence on the landing position of the ink by the airflow under the inkjet head. The airflow under the inkjet head is generated by the transfer of the sheet "P" and the suction of the air by the fan 17. With this airflow, if the ink droplet discharged from the inkjet head 21 is flown in the horizontal direction, the deviation of the landing position is generated. The larger the head gap "H" is, the longer the distance of the ink droplet flowing in the horizontal direction due to the airflow while the ink droplet is flowing becomes. Thus, the deviation of the landing position is easily increased. In other words, the larger the head gap "H" is, the larger the level of the influence of the airflow becomes. The head gap "H" is adjusted according to a type of the sheet to be used for printing.

An action of the inkjet printing apparatus 1 will be described below.

Figure 3:
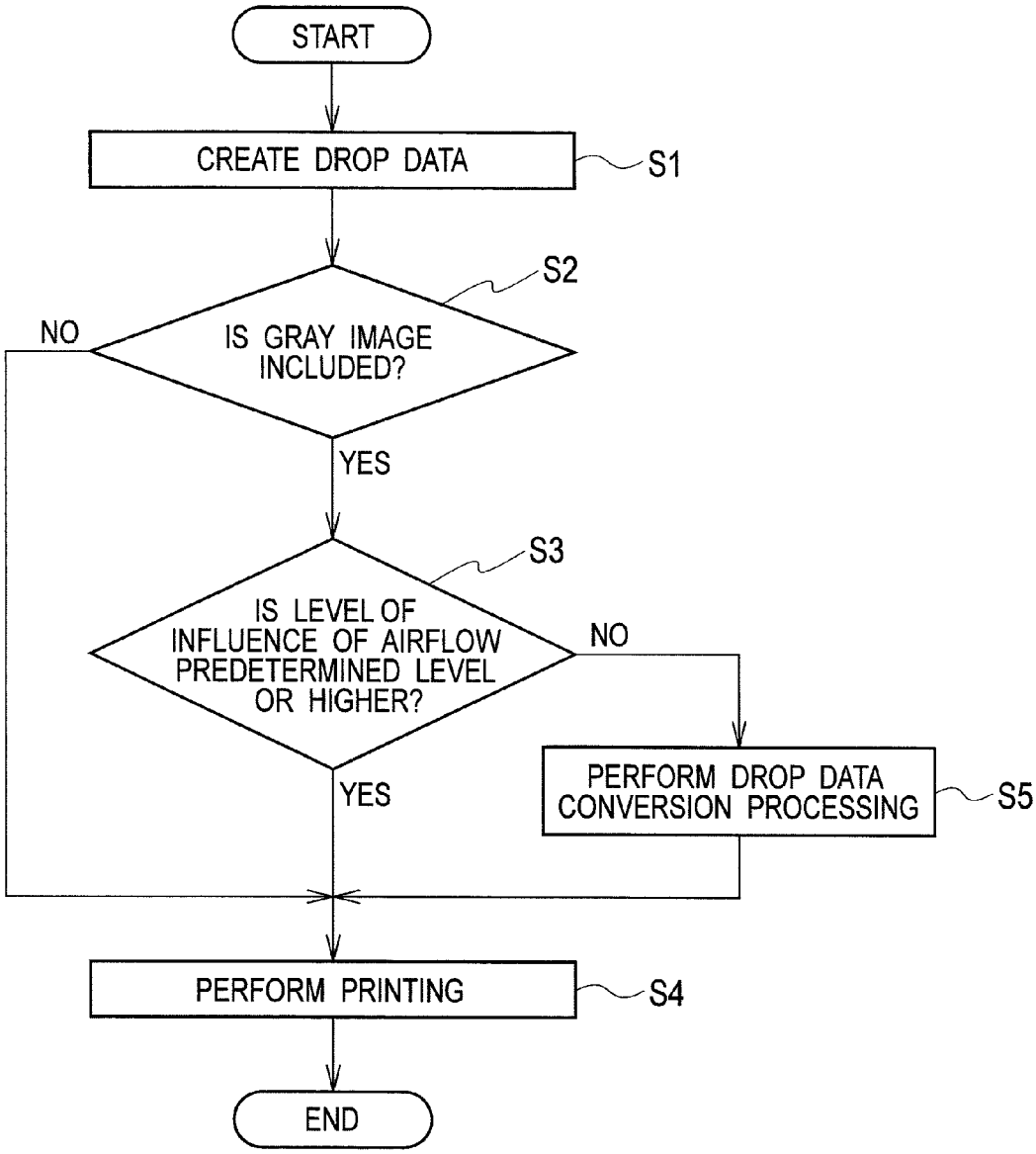
FIG. 3 is a flowchart illustrating an action of the inkjet printing apparatus.

FIG. 3 is a flowchart for illustrating the action of the inkjet printing apparatus 1. Processing of the flowchart illustrated in FIG. 3 is started when print data is input from an outside personal computer to the inkjet printing apparatus 1.

In step S1 illustrated in FIG. 3, the control unit 4 creates drop data from the input print data.

More specifically, the control unit 4 converts the print data in a PDL format into image data in an RGB format. The control unit 4 performs color conversion on the image data in the RGB format to create the image data in each color of C, M, Y, K. The control unit 4 performs, for example, the color conversion with reference to a look-up table (not illustrated) in which a corresponding relationship between an RGB value and a CMYK value is recorded. The control unit 4 performs halftone processing on the image data in each color of C, M, Y, K to create the drop data in each color. The drop data sets the number of the ink droplets (the number of the drops) discharged to each pixel with set print resolution Ra, each ink droplets have predetermined liquid amount.

The control unit 4 creates the drop data to form the gray image with the three colors of C, M, Y. The gray image is an achromatic image having the medium to low density at a predetermined density or less.

In step S2, the control unit 4 determines whether or not the image data to be printed includes the gray image. When it is determined that the gray image is not included (NO in step S2), the control unit 4 proceeds to step S4.

When it is determined that the gray image is included (YES in step S2), then in step S3, the control unit 4 determines whether or not the level of the influence of the airflow when the printing is performed this time is the predetermined level or higher. More specifically, the control unit 4 determines whether or not the head gap according to the type of the sheet to be used for the printing this time is set to a threshold value Hth or more. The control unit 4 can determine the type of the sheet to be used for the printing this time based on information about the sheet included in the print data. Further, the control unit 4 previously stores a setting value of the head gap for each type of the sheet.

As described above, the larger the head gap "H" is, the larger the level of the influence of the airflow becomes. Thus, in the inkjet printing apparatus 1, with reference to the threshold value Hth, when the head gap "H" is the threshold value Hth or more, it is defined that the level of the influence of the airflow is the predetermined level or higher. When the head gap "H" is less than the threshold value Hth, it is defined that the level of the influence of the airflow is lower than the predetermined level.

When it is determined that the level of the influence of the airflow is the predetermined level or higher, in other words, the head gap according to the type of the sheet to be used this time is the threshold value Hth or more (YES in step S3), then in step S4, the control unit 4 performs the printing.

More specifically, the control unit 4 adjusts the head gap "H" to a setting value according to the type of the sheet by the head-gap adjustment unit 23. The control unit 4 then rotates and drives the driving roller 12 by the belt-driving motor 16. With this arrangement, the conveyer belt 11 is driven in a circular manner. Further, the control unit 4 causes the feed paper unit (not illustrated) to feed the sheet "P" to the transfer unit 2. Then, based on the drop data, the control unit 4 drives and controls the inkjet heads 21C, 21K, 21M, 21Y to discharge the ink droplets onto the sheet "P" transferred by the transfer unit 2. With this arrangement, the image is printed on the sheet "P".

On the other hand, in step S3, it is determined that the level of the influence of the airflow is lower than the predetermined level, in other words, that the head gap according to the type of the sheet to be used this time is less than the threshold value Hth (NO in step S3), then in step S5, the control unit 4 performs the drop data conversion processing.

The drop data conversion processing converts the drop data of the gray image. As described above, in step S1, the drop data is created to form the gray image with the three colors of C, M, Y. On the other hand, the drop data conversion processing sets the higher resolution and the smaller ink discharge amount to convert the drop data so as to form the gray image only with the K ink.

More specifically, the control unit 4 changes the print resolution of the gray image to the print resolution Rb that is higher than the set print resolution Ra. The control unit 4 sets the number of the drops of the K ink for each pixel of the gray image at print resolution Rb. At this point, the control unit 4 discharges the smaller amount of the ink than when the gray image is formed with the three colors of C, M, Y. More specifically, the control unit 4 performs the control to set the number of the drops (ink discharge amount) of the K ink discharged for one pixel smaller than the number of drops (ink discharge amount) in each color discharged for one pixel when the gray image is formed with the three colors of C, M, Y. For example, if, when the gray image is formed with the three colors of C, M, Y, the number of the drops in each color discharged for one pixel is two to three drops, the number of the drops of the K ink discharged for one pixel is defined as one drop.

When the drop data conversion processing in step S5 is ended, the control unit 4 proceeds to step S4 to perform the printing. At this point, based on the drop data after the drop data conversion processing is performed, the control unit 4 drives and controls the inkjet heads 21C, 21 K, 21M, 21Y to perform the printing.

In the printing action as described above, FIG. 4 illustrates a dot image of the gray image printed without being subjected to the drop data conversion processing. Further, FIG. 5 illustrates the dot image of the gray image printed after being subjected to the drop data conversion processing.

Each dot Da illustrated in FIG. 4 is formed when the three color inks of C, M, Y have landed in an overlapped manner. The dot Da is formed of the respective color inks injected by two or three drops, for example. The resolution of the image illustrated in FIG. 5 is set higher than that of the image illustrated in FIG. 4. Each dot Db illustrated in FIG. 5 is formed of the landed K ink, for which the smaller amount discharge is set. The dot Db is formed when one drop of the K ink is injected, for example. The dot Db is injected such that the image illustrated in FIG. 5 has the same density as that of the image illustrated in FIG. 4. The higher resolution of the image illustrated in FIG. 5 and the smaller ink discharge amount are set so that the graininess is improved compared with the image illustrated in FIG. 4. In other words, the dot Db illustrated in FIG. 5 is formed to be smaller than the dot Da in the image illustrated in FIG. 4. Further, the dot Db illustrated in FIG. 5 is formed such that the image illustrated in FIG. 5 has the same density as that in FIG. 4. Therefore, compared with the image illustrated in FIG. 4, the pixel included in the image illustrated in FIG. 5 is less visible, and the image illustrated in FIG. 5 is printed to look smoother than the image illustrated in FIG. 4.

As described above, the gray image is formed as illustrated in FIG. 5, when the head gap "H" is less than the threshold value Hth, in other words, when the level of the influence of the airflow is lower than the predetermined level. When the image illustrated in FIG. 5 is formed, since the smaller amount of the discharge of the K ink is set, the ink is easily influenced by the airflow. However, since the head gap "H" is less than the threshold value Hth and the level of the influence of the airflow is low, the deviation of the landing position can be reduced to be small. Therefore, the deterioration of the graininess of the image can be suppressed.

On the other hand, the gray image is formed as illustrated in FIG. 4, when the head gap "H" is the threshold value Hth or more, in other words, when the level of the influence of the airflow is higher than the predetermined level. When the image illustrated in FIG. 4 is formed, since the smaller amount of the discharge of each of the C, M, Y inks is not set but the comparatively large amount of the ink is set, the ink is hardly influenced by the airflow. For example, when two or three drops of the ink are discharged for one pixel from the inkjet head 21, compared with when one drop of the ink is discharged, the airflow has less influence. Therefore, even when the head gap "H" is the threshold value Hth or more and the level of the influence of the airflow is high, the deviation of the landing position can be reduced to be small. Thus, it can be suppressed that the landing positions of the C, M, Y inks are deviated from one another to color the gray image. Further, the deterioration of the graininess of the image can be also suppressed.

As described above, in the inkjet printing apparatus 1, when the level of the influence of the airflow is high, the control unit 4 performs the control to form the gray image with the C, M, Y inks, and when the level of the influence of the airflow is low, the control unit 4 performs the control to form the gray image only with the K ink. When the gray image is formed only with the K ink, the control unit 4 sets the higher resolution and the smaller ink discharge amount than when the gray image is formed with the C, M, Y inks.

With this arrangement, when the level of the influence of the airflow is low, the gray image is formed with the K ink, for which the higher resolution and the smaller ink discharge amount are set, to form the gray image having high graininess. When the smaller ink discharge amount is set, the ink is easily influenced by the airflow, but, since the level of the influence of the airflow is low, the deviation of the landing position can be reduced to be small. Therefore, the deterioration of the graininess of the image can be reduced. Further, since the gray image is formed only with the K ink, the gray image would not be colored.

When the level of the influence of the airflow is high, if the gray image is to be formed only with the K ink, for which the higher resolution and the smaller ink discharge amount are set, the landing position is greatly deviated due to the influence of the airflow to deteriorate the graininess of the image. Further, when the gray image is formed only with the K ink or with the K, C, M, Y inks without setting the higher resolution and the smaller ink discharge amount, a number of pixels need to be thinned off to set target density and thus the graininess of the image may be deteriorated.

When the level of the influence of the airflow is high, the control unit 4 forms the gray image with the C, M, Y inks other than the K ink to form the gray image having the high graininess. Further, since, when the gray image is formed with the C, M, Y inks, each ink is discharged in a comparatively large amount, the deviation of the landing position caused by the influence of the airflow can be suppressed. Therefore, it can be suppressed that the deviations of the landing positions of the C, M, Y inks are generated to color the gray image. Further, the deterioration of the image caused by the deviation of the landing position can be suppressed.

As described above, according to the inkjet printing apparatus 1, the gray image is formed by performing the control according to the level of the influence of the airflow to suppress the deterioration of the graininess of the image, the coloring of the gray image, and thus the deterioration of the print quality of the gray image.

FIG. 6 illustrates a result of an experiment in which the print quality of the gray image is checked according to the embodiment.

According to an experiment 1 illustrated in FIG. 6, as illustrated in FIG. 4, without being subjected to the drop data conversion processing, the gray image having the predetermined density is formed with the C, M, Y inks. According to an experiment 2, as illustrated in FIG. 5, by performing the drop data conversion processing, the higher resolution and the smaller ink discharge amount are set to form the gray image having the predetermined density only with the K ink. According to comparative example 1, without setting the higher resolution and the smaller ink discharge amount, with the same print resolution as that of the experiment example 1, the gray image having the predetermined density is formed only with the K ink. According to comparative example 2, without setting the higher resolution, with the same print resolution as that of the experiment example 1, the small ink discharge amount similarly to the experiment example 2 is set, the gray image having the predetermined density is formed only with the K ink.

In each experiment example, and each comparative example, for each of the cases where the head gaps are H1 and H2, the gray image is formed under the above-described condition. H1<Hth, and in this case, the level of the influence of the airflow is low. On the other hand, H2>Hth, in this case, the level of the influence of the airflow is high.

In each experiment example, and each comparative example, based on the color and the graininess, the print quality of the gray image is evaluated. In FIG. 6, an evaluation result is indicated as four-class evaluation of "A", "B", "C", and "D". In turn of the evaluation result of "A", "B", "C", and "C", the print quality of corresponding each experiment example and each comparative example becomes more deteriorated. The evaluation "A" indicates the best print quality, and the "D" indicates the worst print quality.

As illustrated in FIG. 6, when the head gap is H1, in other words, when the level of the influence of the airflow is low, the best print quality can be obtained in the experiment example 2. When the head gap is H2, in other words, when the level of the influence of the airflow is high, the best print quality can be obtained in the experiment example 1. With the experiment result described above, effects of the present embodiment can be confirmed.

More specifically, in the inkjet printing apparatus 1 according to the present invention, in a case where the gray image is formed by the printing unit 3, and when the level of the influence on the landing position of the ink by the airflow under the inkjet head 21 is the predetermined level or higher, the control unit 4 performs the control to form the gray image with the three color inks other than the black ink, and when the level of the influence is lower than the predetermined level, to form the gray image with the K ink. When the gray image is formed with the K ink, the control unit 4 controls the printing unit 3 to set the higher print resolution and the smaller ink discharge amount for one pixel from the inkjet head 21 than when the gray image is formed with other three inks. As described above, the control unit 4 forms the gray image by performing the control according to the level of the influence on the landing position of the ink by the airflow under the inkjet head 21 such that the deterioration of the graininess of the image can be suppressed, coloring the gray image can be suppressed, and thus the deterioration of the print quality of the gray image can be suppressed.

Further, the inkjet head 21 of the K ink performs the print processing with the higher resolution than other inkjet heads. In a case where the gray image is formed by the printing unit 3, and when the level of the influence on the landing position of the ink by the airflow under the inkjet head 21 is the predetermined level or higher, the control unit 4 forms the gray image with the three color inks (C, M, Y) other than the black ink, and when the level of the influence is lower than the predetermined level, forms the gray image by using only the black ink and setting a smaller ink discharge amount for one pixel from the inkjet head 21 than when the gray image is formed with the other three inks (C, M, Y). As described above, the control unit 4 performs the control according to the level of the influence on the landing position of the ink by the airflow under the inkjet head 21 to form the gray image, so that the deterioration of the graininess of the image can be suppressed, coloring the gray image can be suppressed, and thus the deterioration of the print quality of the gray image can be suppressed.

According to the present embodiment, it is described that the level of the influence of the airflow depends on the head gap "H", but it is not limited thereto. For example, in some transfer methods of the sheet, on the print surface of the sheet, the influence of the airflow may vary depending on a location. In such a case, the gray image printed at a location where the level of the influence of the airflow is high may be formed with the C, M, Y inks, and the gray image printed at a location where the level of the influence of the airflow is low may be formed only with the K ink, for which the higher resolution and the smaller ink discharge amount are set.

Further, according to the present embodiment, the number of the ink droplets (the number of the drops) is set to be small to set the small ink discharge amount, each ink droplets have predetermined liquid amount, but the predetermined liquid amount of each ink droplets may be set to be small to set the small ink discharge amount.

The present invention is not limited to the above-described embodiment as it is, and in a phase of performing the embodiment, the configuration elements can be modified and embodied, as long as it does not depart from the scope of the present invention. Further, a plurality of configuration elements disclosed in the above-described embodiment is appropriately combined with each other to form various types of inventions. For example, some configuration elements may be deleted from whole configuration elements described in the embodiment.

The present application claims the priority based on the Japanese Patent Application No. 2013-121477 filed on the 10 Jun. 2013. The whole content of the application is incorporated by reference herein.

INDUSTRIAL APPLICABILITY

According to the inkjet printing apparatus of the present invention, when the gray image is formed, according to the level of the influence on the landing position of the ink by the airflow under the inkjet head, a case when only black is used and a case when the three colors of cyan, magenta, and yellow other than black are used are changed. With this arrangement, the deterioration of the graininess of the image can be suppressed, coloring the gray image can be suppressed, and thus the deterioration of the print quality of the gray image can be suppressed.

What is claimed is:

1. An inkjet printing apparatus comprising:

a printing unit including four inkjet heads configured to discharge black, cyan, magenta, and yellow inks, respectively, to a transferred sheet; and a control unit configured to control the printing unit, wherein the control unit, when forming a gray image by the printing unit, determines whether or not a level of influence on an ink landing position by an airflow under the inkjet head is a predetermined level or higher, controls the printing unit to form the gray image with three color inks other than the black ink, when the level of the influence is a predetermined level or higher, controls the printing unit to form the gray image with the black ink, when the level of the influence is less than the predetermined level, and controls the printing unit to set higher print resolution and set smaller an ink discharge amount for one pixel from the inkjet head than when forming the gray image with other three color inks, in the control to form the gray image with the black ink.

2. An inkjet printing apparatus, comprising:

a printing unit which includes four inkjet heads configured to discharge black, cyan, magenta, and yellow inks, respectively, to a transferred sheet and in which the black inkjet head performs print processing with a resolution higher than resolutions of other inkjet heads; and a control unit configured to control the printing unit, wherein the control unit, when forming a gray image by the printing unit, determines whether or not a level of influence on an ink landing position by an airflow under the inkjet head is a predetermined level or higher, controls the printing unit to form the gray image with three color inks other than the black ink, when the level of the influence is a predetermined level or higher, and forms the gray image by using only the black ink and setting smaller an ink discharge amount for one pixel from the inkjet head than when forming the gray image with the three color inks, when the level of the influence is lower than the predetermined level.

* * * * *